United States Patent [19]

Leifeld et al.

[11] Patent Number: 4,987,646

[45] Date of Patent: Jan. 29, 1991

[54] METHOD AND APPARATUS FOR OPERATING A FIBER TUFT FEEDER

[75] Inventors: Ferdinand Leifeld, Kempen; Josef Temburg, Jüchen, both, Fed. Rep. of Germany

[73] Assignee: Trützschler GmbH & Co. KG, Mönchen-Gladbach, Fed. Rep. of Germany

[21] Appl. No.: 481,594

[22] Filed: Feb. 20, 1990

[30] Foreign Application Priority Data

Feb. 20, 1989 [DE] Fed. Rep. of Germany ..... 3905138
Oct. 12, 1989 [DE] Fed. Rep. of Germany ..... 3934040

[51] Int. Cl.[5] ..... D01G 9/16
[52] U.S. Cl. ..... 19/97.5
[58] Field of Search ..... 19/92, 97.5, 204

[56] References Cited

U.S. PATENT DOCUMENTS

| | | | |
|---|---|---|---|
| 1,982,414 | 11/1934 | Blackwood et al. | 19/97.5 |
| 3,680,192 | 8/1972 | Stevels | 19/97.5 |
| 3,738,476 | 6/1973 | Hullett et al. | 19/97.5 |
| 4,903,374 | 2/1990 | Höel | 19/97.5 |

FOREIGN PATENT DOCUMENTS

| | | | |
|---|---|---|---|
| 000378 | 1/1979 | European Pat. Off. . | |
| 429587 | 3/1934 | United Kingdom | 19/97.5 |
| 442926 | 2/1936 | United Kingdom . | |
| 683606 | 12/1952 | United Kingdom . | |
| 770897 | 3/1957 | United Kingdom . | |
| 1085022 | 9/1967 | United Kingdom . | |
| 1307275 | 2/1973 | United Kingdom . | |
| 1345175 | 1/1974 | United Kingdom . | |
| 1368488 | 9/1974 | United Kingdom . | |

*Primary Examiner*—Werner H. Schroeder
*Assistant Examiner*—John J. Calvert
*Attorney, Agent, or Firm*—Spencer & Frank

[57] ABSTRACT

A fiber feeder apparatus includes a driven endless supply conveyor belt having a coneveying surface for supporting a fiber pile and an endless spiked lattice arranged at one end of the supply conveyor belt and extending at an upward inclination therefrom. The spiked lattice has spikes arranged to penetrate into the fiber pile for effecting removal of fibers from the fiber pile. The supply conveyor belt is driven such that the fiber pile is being fed by the conveying surface into contact with the spikes. There is further provided a control device which is connected to the drive of the supply conveyor belt for effecting a nonuniform driving thereof.

11 Claims, 3 Drawing Sheets

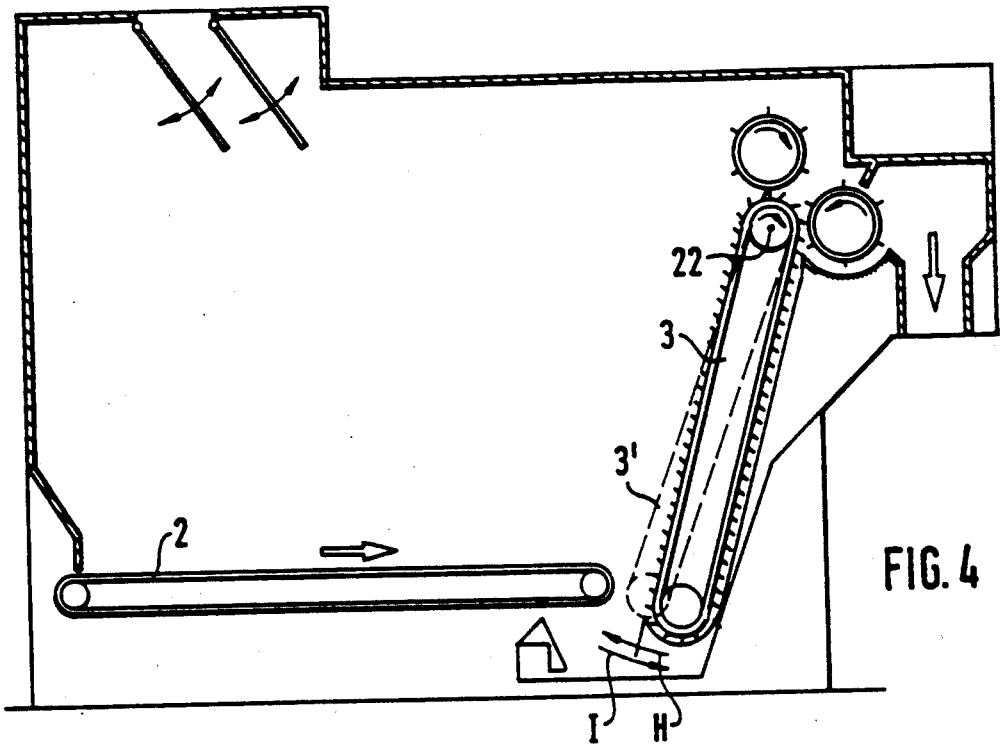
FIG. 4
FIG. 5
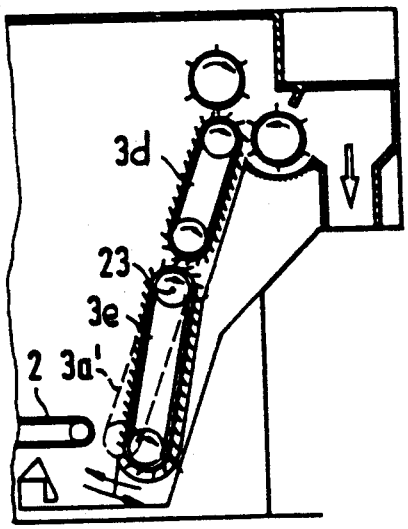
FIG. 6
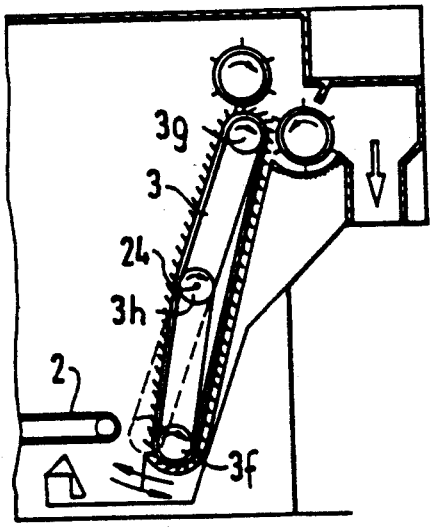

METHOD AND APPARATUS FOR OPERATING A FIBER TUFT FEEDER

CROSS REFERENCE TO RELATED APPLICATION

This application claims the priority of Federal Republic of Germany Application Nos. P 39 05 138.2 filed Feb. 20th, 1989 and P 39 34 040.6 filed Oct. 12th, 1989, which are incorporated herein by reference.

BACKGROUND OF THE INVENTION

This invention relates to a method and an apparatus for operating a feeding device for fiber material, such as a boxed feeder assembly in which the fiber material is deposited on the upper side of an endless supply belt which is supported by two rotary end rollers and which is driven at low speed. As the upper (conveying) flight of the supply belt is moved in a forward direction, the fiber material thereon is advanced to a steeply upwardly inclined spiked lattice which carries the fiber material upwardly.

It has been found that as the spiked lattice carries away material from the fiber pile, in the upper zone of the fiber pile the material is not removed as satisfactorily by the spiked lattice as in the lower zone where the empty spikes may penetrate into the fiber pile from below and where a relatively large pressing force prevails. This leads to a rolling in the upper zone and to an undesired increase of the pile material immediately adjacent the spiked lattice. This leads to disadvantages in the blending of the fibers and to operational difficulties in the machine, particularly at high outputs.

In a known method the fiber supply belt is driven at constant speed which affects in a large measure the output of the machine. The speed of the spiked lattice, the fill height as well as the pressure of the piled-up fiber material also have an effect on the output. The above-noted rolling causes nonuniform pressing forces and continuously fluctuating fill heights. It is particularly of disadvantage that the upper, lighter layers of the fiber pile have significantly reduced chances to be entrained by the spikes since the latter have already been filled in the lower zones, particularly because of their favorable arrangement and the high pressing forces there. Such high pressing forces are present in the lower zone because of the greater, weight-caused compression and the closer proximity of the material to the supply belt where the feeding forces are still highly effective.

SUMMARY OF THE INVENTION

It is an object of the invention to provide an improved method and apparatus of the above-outlined type from which the discussed disadvantages are eliminated and which, in particular, makes possible a more uniform removal of fibers from the fiber pile by the spiked lattice and an improvement of the fiber blend.

This object and others to become apparent as the specification progresses, are accomplished by the invention, according to which, briefly stated, the supply conveyor is, during its energized state, nonuniformly driven.

Expediently, the drive means for the supply conveyor may be controlled such that the speed of the supply conveyor is periodically altered. By driving the supply conveyor at nonuniform speed, the fiber supply is not fed to the spiked lattice with constant speed so that the upper and the lower layers of the fiber pile are engaged by the ascending spiked lattice in a varying manner.

The nonuniform speed of the supply conveyor may be ensured according to the invention by driving the supply conveyor intermittently, for example, by effecting a stand-still for several seconds or minutes. According to another feature of the invention, the direction of advance of the supply conveyor is reversed for a short period. By virtue of this arrangement the fiber mass constituting the material pile is normally moved towards the spiked lattice and, for short periods of time, is moved away therefrom. During the phase of movement of fiber material towards the spiked lattice, the lower spikes thereof are being filled with material. In the phase in which the supply conveyor belt travels in a direction away from the spiked lattice, the spikes at the lower zone remain freer and these spikes then are penetrating into the upper zone of the fiber pile where, as a reaction to the motion of the conveyor belt away from the spiked lattice, the inertia of the material and the reverse feed force cause an accumulation of fiber material against the spiked lattice in a zone above the supply conveyor. According to a further feature of the invention, the supply conveyor belt executes a "pilgrim step" movement where the short-period paths towards the spiked lattice are always greater than the short-period paths oriented away from the spiked lattice.

The apparatus according to the invention has an endless conveyor belt supported by two rotary end rollers driven at low speeds and has a spiked lattice which is arranged at the downstream end of the supply conveyor belt and which is inclined upwardly in the ascending direction. During the supply of material bY the conveyor belt, the upper face thereof runs in the direction of the spiked lattice and a drive arrangement is provided for the supply conveyor belt which includes a control device for driving the conveyor belt in a nonuniform manner.

According to an advantageous feature of the invention, the control device is also connected to the drive motor of the spiked lattice to thus coordinate the control of the supply conveyor belt with the speed of the spiked lattice. Such an arrangement is of advantage, because in this manner the influence that the spiked lattice speed has on the location and periods of engagement by the spikes into the fiber pile can be controlled.

According to another advantageous feature of the invention, the control device is connected with a height level measuring arrangement which detects the height of the fiber pile. By applying data concerning the extent of fill (fiber pile height) and the feeder output together with the earlier-mentioned parameters to the control device, the latter may automatically set the feeder output to a desired, predetermined value.

BRIEF DESCRIPTION OF THE DRAWING

FIGS. 4, 5 and 6 are schematic side elevational views of three further preferred embodiments of the invention.

DESCRIPTION OF THE PREFERRED EMBODIMENTS

Figure 1A:
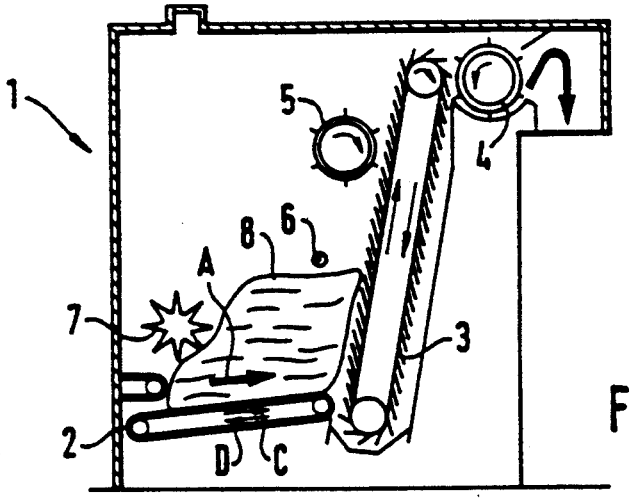
FIGS. 1*a*, 1*b* and 1*c* are schematic side elevational views illustrating a preferred embodiment of the method according to the invention.
Figure 1B:
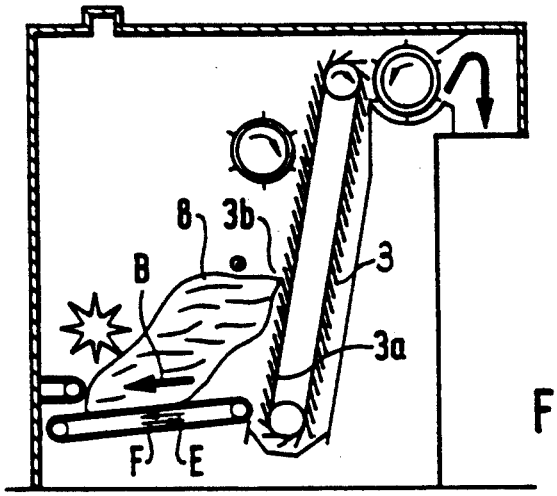
Figure 1C:
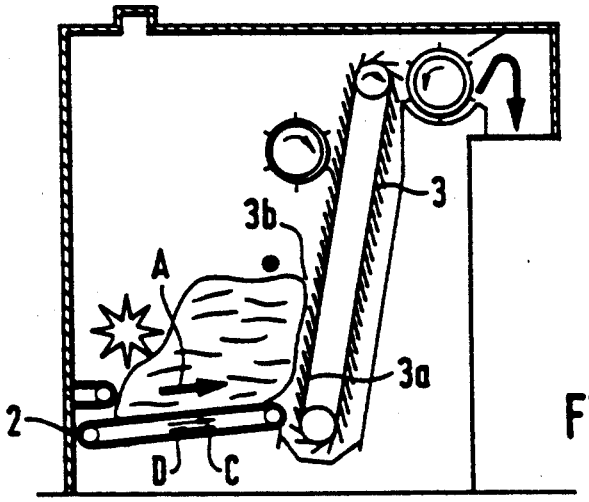

Turning to FIGS. 1*a*, 1*b* and 1*c*, there is illustrated therein a boxed feeder assembly comprising an endless supply conveyor belt 2, an endless spiked lattice 3, a stripper roller 4, an evener roller 5 and an optical barrier 6. A star roller 7 is positioned above the supply conveyor 2, at the inlet end thereof for retaining fiber material piled up on the conveyor belt 2. The above-described construction is conventional; it may be, for example, a model MWSE Weighing Hopper Feeder, manufactured by Trützschler GmbH & Co. KG, Mönchengladbach, Federal Republic of Germany.

As illustrated in FIG. 1*a*, the fiber material (fiber pile) 8 is moved by the conveyor belt 2 in the direction A towards the spiked lattice 3. Arrows C and D indicate the running direction of the upper and lower flights of the conveyor belt 2. As shown by arrows E and F of FIG. 1*b*, according to the invention, the running direction of the conveyor belt 2 is periodically reversed. By virtue of such a reverse run, which is of short duration, the lower zone of the fiber supply (fiber pile) 8 slowly shifts in the direction of the arrow B while the upper zone of the fiber pile 8 substantially retains its position due to inertia forces. Thus, the upper zone of fiber pile 8 continues to engage the spiked lattice 3 as it slightly tilts theretoward. Due to the movement of the lower part of the fiber pile 8 away from the spiked lattice 3 in the direction of the arrow B, between the lower zone of the pile 8 and the spikes 3*a* of the spiked lattice, a material-free space is provided, so that the spikes 3*a* do not penetrate into the fiber material in that zone. As soon as the fiber-free spikes 3*a* arrive in the upper position 3*b* of FIG. 1*b*, they penetrate into the fiber material in the upper zone of the fiber pile 8 which, as described above, remains in engagement with the spiked lattice 3. Subsequently, as shown in FIG. 1*c*, the running direction of the conveyor belt 2 is again reversed to run in the direction of the arrows C and D as in FIG. 1*a* so that the fiber material 8 is again in its entirety moved in the direction of the arrow A towards the spiked lattice 3.

Figure 2:
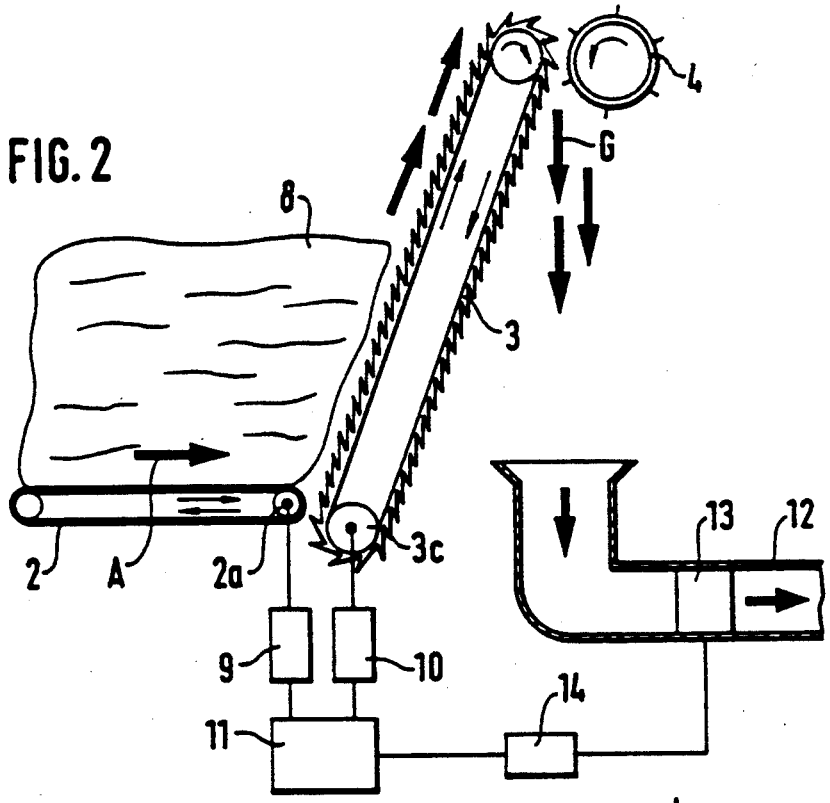
FIG. 2 is a schematic side elevational view of an apparatus, with block diagram, according to a preferred embodiment of the invention.

Turning now to FIG. 2, the end roller 2*a* of the conveyor belt 2 is driven by a speed-variable drive motor 9, whereas the support roller 3*c* of the spiked lattice 3 is driven by a speed-variable drive motor 10. Both motors 9 and 10 are connected with a control and regulating device 11. The fiber tufts G removed from the spiked lattice by the stripper roller 4 fall into a pneumatic conveyor duct 12 in which there is disposed a fiber material throughput measuring device 13 which is connected to the control and regulating device 11 with the intermediary of an evaluating device 14. The fiber pile 8 is moved on the conveyor belt 2 in the direction of the arrow A towards the spiked lattice 3. The conveyor belt 2 is, according to the invention, driven noncontinuously, that is, the running speed of the conveyor belt 2 is altered for short periods of time. Dependent upon the material throughput as sensed by the measuring device 13, the feed of fiber material is regulated by varying the speed of the roller 2*a* and/or 3*c* of the conveyor belt 2 and the spiked lattice 3, respectively, by changing the speed of the motors 9 and/or 10 with the control and regulating device 11. In the regulating device 11 the speed alteration (for example, periodic reversal of the run of the motor 2) may be set to occur automatically.

Figure 3:
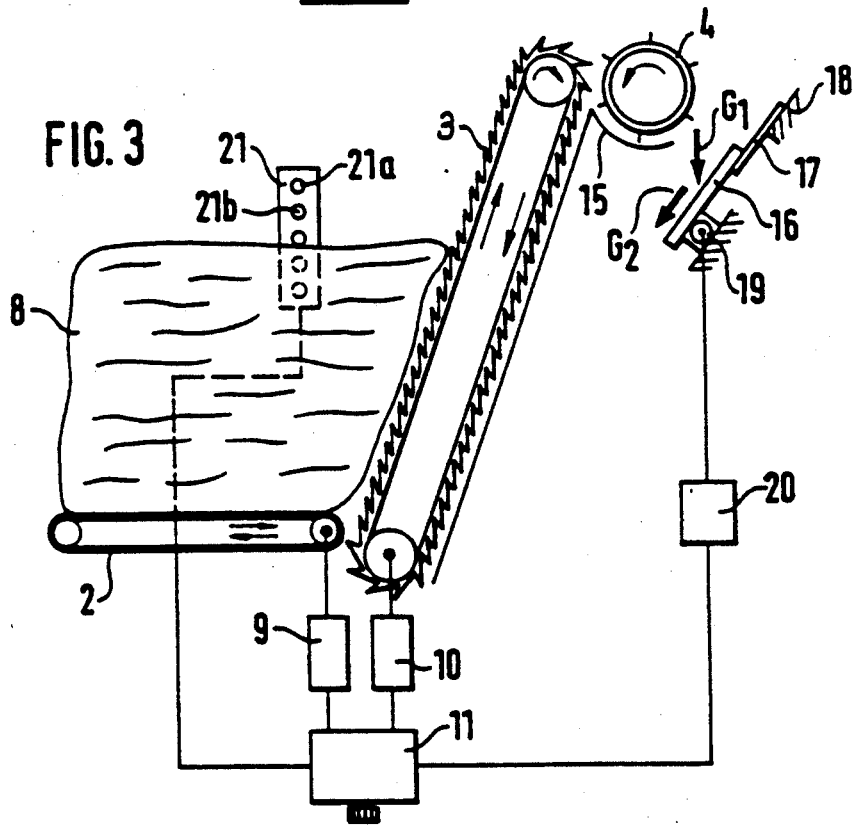
FIG. 3 is a schematic side elevational view, with block diagram, of another preferred embodiment of the invention.

Turning to FIG. 3, in the feeder assembly, underneath the stripping roller 4, an arcuate guide plate 15 is provided for guiding the fiber tufts removed from the spiked lattice 3 by the stripper roller 4. A downwardly inclined impact plate 16, mounted on a stationary support 18 by means of a leaf spring 17 faces the open, discharge end of the curved plate 15. The underside of the impact plate 16 is in contact with a force-measuring box 19 which is connected to the control and regulating device 11 by means of an evaluating device 20. The fiber tuft stream $G_1$ impinges from above on the upper face of the impact plate 16 and is deflected thereby downwardly to continue as a fiber tuft stream $G_2$. Further, above the conveyor belt 2 a height-measuring device 21 is arranged for detecting the height level of the fiber pile (fiber supply) 8 which is situated on the conveyor belt 2. The height-measuring device 21 comprises a plurality of vertically superposed photocells (such as optical barriers or the like) 21*a* . . . 21*n*. The height-measuring device 21 is coupled to the control and regulating device 11 so that the latter may control the speed of the motors 9 and 10 to thus regulate the fiber supply as a function of its height as sensed by the measuring device 21.

Turning now to FIG. 4, the spiked lattice 3 may be pivotal towards or away from the conveyor belt 2 about a horizontal pivot axis 22 as indicated by the arrows I and H. The position of the spiked lattice 3 in its near position to the conveyor belt 2 is illustrated in phantom lines at 3'.

Turning now to FIG. 5, there are illustrated two spiked lattices 3*d* and 3*e* arranged in series, wherein the lower spiked lattice 3*c* is pivotal about a horizontal axis 23.

Turning to the embodiment shown in FIG. 6, the spiked lattice 3 is supported by end rollers 3*f* and 3*g*, between which there is stationarily supported a further rotary roller 3*h*. That portion of the spiked lattice which extends between the roller 3*h* and the lower support roller 3*f* is pivotal about a horizontal pivot axis 24 which passes through the intermediate roller 3*h*. Such a pivotal motion may be effected by any conventional linkage mechanism.

It will be understood that the above description of the present invention is susceptible to various modifications, changes and adaptations, and the same are intended to be comprehended within the meaning and range of equivalents of the appended claims.

What is claimed is:

1. A fiber feeder apparatus comprising:

(a) an endless supply conveyor belt having a conveying surface for supporting a fiber pile;

(b) an endless spiked lattice arranged at one end of the supply conveyor belt and extending at an upward inclination therefrom; said spiked lattice having spikes arranged to penetrate into the fiber pile;

(c) first drive means connected to said spiked lattice for driving the spiked lattice in a conveying direction oriented upwardly from the supply conveyor belt for effecting removal of fibers from the fiber pile by the spikes and entrainment of the fibers by the spiked lattice upwardly from the fiber pile;

(d) a second drive means connected to said supply conveyor belt for driving said supply conveyor belt such that the fiber pile is being fed by the conveying surface into contact with said spikes; and (e) control means connected to said second drive means for effecting a nonuniform driving of said supply conveyor belt; said control means comprising a time control device;

(f) device and means for reversing direction of said supply convey or belt.

2. An apparatus as defined in claim 1, wherein said control means comprises a path controlling device.

3. An apparatus as defined in claim 1, wherein said control means is connected to said first drive means for controlling the operation of the spiked lattice.

4. An apparatus as defined in claim 1, further comprising quantity measuring means for monitoring the quantity of the fiber pile situated on said conveying surface of said endless supply conveyor belt; said quantity measuring means being connected to said control means for applying to said control means signals representing the quantity of the fiber pile.

5. An apparatus as defined in claim 4, wherein said quantity measuring means comprises an optical barrier including a plurality of vertically superposed photocells for measuring the height of the fiber pile situated on said conveying surface.

6. An apparatus as defined in claim 1, further comprising fiber quantity measuring means for measuring the quantity of fiber subsequently to a discharge thereof by said spiked lattice; said fiber quantity measuring means being connected to said control means for applying to said control means signals representing the fiber quantity discharged by said spiked lattice.

7. An apparatus as defined in claim 6, wherein said fiber quantity measuring means comprises a fiber material throughput measuring device.

8. A method of operating a feeder for fiber material comprising the steps of (a) positioning a fiber material pile on a supply conveyor;

(b) nonuniformly driving the supply conveyor toward a spiked lattice with nonuniform speed for moving the fiber pile into contact with the spiked lattice; said step of nonuniformly driving the supply conveyor including the step of periodically reversing the travelling direction of the supply conveyor for short durations; and (c) driving the spiked lattice for causing spikes of the spiked lattice to penetrate into the fiber material and to remove and carry away in an upward direction fiber therefrom.

9. A method as defined in claim 8, wherein the length of the path travelled by the supply conveyor in a forward direction towards said spiked lattice during each period of forward travel is greater than the length of the path travelled by the supply conveyor in a reverse direction away from said spiked lattice during each period of reverse travel.

10. A fiber feeder apparatus comprising:

(a) an endless supply conveyor belt having a conveying surface for supporting a fiber pile;

(b) an endless spiked lattice arranged at one end of the supply conveyor belt and extending at an upward inclination therefrom; said spiked lattice having spikes arranged to penetrate into the fiber pile and having an upper and a lower end;

(c) means for pivotally supporting the spiked lattice to permit the lower end to carry out a swinging motion towards and away from said endless supply conveyor belt;

(d) first drive means connected to said spiked lattice for driving the spiked lattice in a conveying direction oriented upwardly from the supply conveyor belt for effecting removal of fibers from the fiber pile by the spikes and entrainment of the fibers by the spiked lattice upwardly from the fiber pile; and (e) a second drive means connected to said supply conveyor belt for driving said supply conveyor belt such that the fiber pile is being fed by the conveying surface into contact with said spikes.

11. A fiber feeder apparatus comprising:

(a) an endless supply conveyor belt having a conveying surface for supporting a fiber pile;

(b) an endless spiked lattice arranged at one end of the supply conveyor belt and extending at an upward inclination therefrom; said spiked lattice having spikes arranged to penetrate into the fiber pile;

(c) first drive means connected to said spiked lattice for driving the spiked lattice in a conveying direction oriented upwardly from the supply conveyor belt for effecting removal of fibers from the fiber pile by the spikes and entrainment of the fibers by the spiked lattice upwardly from the fiber pile;

(d) a second drive means connected to said supply conveyor belt for driving said supply conveyor belt such that the fiber pile is being fed by the conveying surface into contact with said spikes; and (e) control means connected to said second drive means for effecting a nonuniform driving of said supply conveyor belt; said control means being arranged for reversing an operating direction of said second drive means.

* * * * *